US009441627B2

(12) United States Patent
Kitching

(10) Patent No.: US 9,441,627 B2
(45) Date of Patent: Sep. 13, 2016

(54) LIGHTWEIGHT AND FLEXIBLE ROTORS FOR POSITIVE DISPLACEMENT DEVICES

(71) Applicant: National Oilwell Varco, L.P., Houston, TX (US)

(72) Inventor: Alan H. Kitching, Katy, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 287 days.

(21) Appl. No.: 14/069,802

(22) Filed: Nov. 1, 2013

(65) Prior Publication Data

US 2014/0119974 A1 May 1, 2014

Related U.S. Application Data

(60) Provisional application No. 61/721,119, filed on Nov. 1, 2012.

(51) Int. Cl.

| | |
|---|---|
| ***F04C 2/08*** | (2006.01) |
| ***F04C 2/107*** | (2006.01) |
| ***F01C 21/08*** | (2006.01) |

(52) U.S. Cl.

CPC ..... *F04C 2/082* (2013.01); *F01C 21/08* (2013.01); *F04C 2/1071* (2013.01)

(58) Field of Classification Search

CPC ..... F04C 2/1071; F04C 2/1075

USPC ..... 418/48, 50

See application file for complete search history.

(56) References Cited

U.S. PATENT DOCUMENTS

| | | | | | |
|---|---|---|---|---|---|
| 2,525,265 | A | * | 10/1950 | Moineau | F04C 2/1078 418/48 |
| 4,187,061 | A | * | 2/1980 | Jurgens | F04C 2/1073 418/48 |
| 4,614,232 | A | * | 9/1986 | Jurgens | F04C 11/003 418/48 |
| 4,636,151 | A | | 1/1987 | Eppink | |
| 5,171,138 | A | | 12/1992 | Forrest | |
| 5,248,896 | A | | 9/1993 | Forrest | |
| 5,310,320 | A | | 5/1994 | Timuska | |
| 5,549,465 | A | | 8/1996 | Varadan | |
| 5,611,397 | A | | 3/1997 | Wood | |

(Continued)

FOREIGN PATENT DOCUMENTS

| | | | | |
|---|---|---|---|---|
| DE | 1816462 A1 | * | 7/1970 | F04C 2/1071 |
| EP | 1406016 A1 | | 4/2004 | |
| WO | 2012/024215 A2 | | 2/2012 | |

OTHER PUBLICATIONS

Davis, J.R. (1998). Metals Handbook, Desk Edition (2nd Edition). ASM International. Online version available at: http://app.knovel.com/hotlink/toc/id:kpMHDEE004/metals-handbook-desk/metals-handbook-desk; p. 77.*

(Continued)

*Primary Examiner* — Mary A Davis
(74) *Attorney, Agent, or Firm* — Conley Rose, P.C.

(57) ABSTRACT

A rotor for a progressive cavity device has a central axis and includes an outer tubular. The outer tubular has a radially outer surface and a radially inner surface defining a rotor cavity. The outer surface includes at least one helical rotor lobe. The rotor also includes a filler structure disposed within the rotor cavity. The outer tubular is made of a first material having a first density and the filler structure is made of a second material having a second density that is less than the first density.

23 Claims, 8 Drawing Sheets

(56) References Cited

U.S. PATENT DOCUMENTS

| | | | | |
|---|---|---|---|---|
| 5,697,768 | A | 12/1997 | Mills | |
| 6,543,132 | B1 | 4/2003 | Krueger et al. | |
| 6,544,015 | B1 | 4/2003 | Kaechele | |
| 6,905,319 | B2 | 6/2005 | Guo | |
| 7,442,019 | B2 * | 10/2008 | Kaiser | F04C 2/1075 418/48 |
| 7,909,591 | B2 | 3/2011 | Kachele | |
| 9,045,943 | B2 * | 6/2015 | Puzz | F04C 2/1075 |
| 2003/0143094 | A1 | 7/2003 | Guo | |
| 2006/0131079 | A1 | 6/2006 | Bottos | |
| 2008/0264593 | A1 | 10/2008 | Sindt | |
| 2010/0038142 | A1 * | 2/2010 | Snyder | F04C 2/1071 418/48 |
| 2010/0108393 | A1 | 5/2010 | John et al. | |
| 2011/0070111 | A1 | 3/2011 | Slay et al. | |
| 2011/0271527 | A1 | 11/2011 | Lee et al. | |
| 2013/0048384 | A1 * | 2/2013 | Jarvis | F04C 2/1071 418/48 |

OTHER PUBLICATIONS

Oberg, Erik Jones, Franklin D. Horton, Holbrook L. Ryffel, Henry H., (2012). Machinery's Handbook (29th Edition) & Guide to Machinery's Handbook. Industrial Press. Online version available at: http://app.knovel.com/hotlink/toc/id:kpMHEGMH24/machinerys-handbook-29th/machinerys-handbook-29th; pp. 376, 377,389, 390, 393.*

Canadian Office Action dated Jan. 23, 2015; Canadian Application No. 2,831,980 (3 p.).

* cited by examiner

LIGHTWEIGHT AND FLEXIBLE ROTORS FOR POSITIVE DISPLACEMENT DEVICES

CROSS-REFERENCE TO RELATED APPLICATIONS

This application claims benefit of U.S. provisional patent application Ser. No. 61/721,119 filed Nov. 1, 2012, and entitled "Lightweight and Flexible Rotor for Positive Displacement Devices," which is hereby incorporated herein by reference in its entirety.

STATEMENT REGARDING FEDERALLY SPONSORED RESEARCH OR DEVELOPMENT

Not applicable.

BACKGROUND

The present disclosure relates generally to positive-displacement devices that include rotors rotatably disposed in stators. More specifically, the present disclosure relates to rotors for positive-displacement devices.

A progressive cavity pump (PC pump) transfers fluid by means of a sequence of discrete cavities that move through the pump as a rotor is turned within a stator. The transfer of fluid in this manner results in a volumetric flow rate proportional to the rotational speed of the rotor within the stator, as well as relatively low levels of shearing applied to the fluid. Consequently, progressive cavity pumps are typically used in fluid metering and pumping of viscous or shear sensitive fluids, particularly in downhole operations for the ultimate recovery of oil and gas. Progressive cavity pumps may also be referred to as PC pumps, progressing cavity pumps, "Moineau" pumps, eccentric screw pumps, or cavity pumps.

A PC pump may be used in reverse as a progressive cavity motor (PC motor) by passing fluid through the cavities between the rotor and stator to power the rotation of the rotor relative to the stator, thereby converting the hydraulic energy of a high pressure fluid into mechanical energy in the form of speed and torque output, which may be harnessed for a variety of applications, including downhole drilling. Progressive cavity motors may also be referred to as positive displacement motors (PD motors), eccentric screw motors, or cavity motors. PD motors, or simply mud motors, are used in the directional drilling of oil and gas wells.

Progressive cavity devices (e.g., progressive cavity pumps and motors) include a stator having a helical internal bore and a helical rotor rotatably disposed within the stator bore. Conventional stators often comprise a radially outer tubular housing and a radially inner component disposed within the housing. The inner component has a cylindrical outer surface that is bonded to the cylindrical inner surface of the housing and a helical inner surface that defines the helical bore of the stator. Alternatively, the housing may have a helical bore and the inner component may comprise a relatively thin, uniform thickness coating on the helical inner surface of the housing. In either case, the inner component is typically made of an elastomeric material and is disposed within the stator housing, and thus, may also be referred to as an elastomeric stator liner or insert. The elastomeric stator insert provides a surface having some resilience to facilitate the interference fit between the stator and the rotor. Conventional rotors often comprise a steel tube or rod having a helical-shaped outer surface, which may be chrome-plated or coated for wear and corrosion resistance. The helical internal bore defines lobes on the inner surface of the stator and the helical-shaped outer surface of the rotor defines at least one lobe on the outer surface of the rotor. In general, the rotor may have one or more lobes. To satisfy the fundamental gear tooth law, the stator will have one more lobe than the rotor.

When the rotor and stator are assembled, the rotor and stator lobes intermesh to form a series of cavities. More specifically, an interference fit between the helical outer surface of the rotor and the helical inner surface of the stator results in a plurality of circumferentially spaced hollow cavities in which fluid can travel. During rotation of the rotor, these hollow cavities advance from one end of the stator towards the other end of the stator. Each cavity is sealed from adjacent cavities by seals formed along contact lines between the rotor and the stator. For example, during downhole drilling operations, drilling fluid or mud is pumped through the PD motor as the sealed cavities progressively opening and closing to accommodate the circulating mud. Pressure differentials across adjacent cavities exert forces on the rotor that causes the rotor to rotate within the stator. The centerline of the rotor is typically offset from the center of the stator so that the rotor rotates within the stator on an eccentric orbit. The amount of torque generated by the power section depends on the cavity volume and pressure differential.

In directional drilling, the PC motor is usually positioned at the bottom of a drill string, with the downhole end of the rotor connected to the drill bit via a driveshaft and a shaft concentrically disposed in a bearing assembly and coaxially aligned with the drill bit. To transmit torque from the eccentric rotor to the concentric drill bit, a flexible driveshaft or an articulated driveshaft with universal joints is used to connect the rotor to the shaft of the bearing assembly.

The rotor applies loads to the stator as it rotates therein. The loads come, at least in part, from the work required to rotate the rotor mass within the stator. The loads also come from out-of-balance forces generated as the rotor mass rotates at speed on an eccentric orbit, as well as from other radial forces generated by the rotor mass. The loads can also come from operational circumstances, such as when drilling a curved or deviated section of a borehole. In particular, when drilling a curve, the stator is often bent while the rotor is rotating within the stator. The stator will in turn try to bend the rotor, and the forces from this attempt will be imparted on the stator profile. In general, the higher the loads exerted on the stator by the rotor, the shorter the useful life of the stator.

BRIEF SUMMARY OF THE DISCLOSURE

These and other needs in the art are addressed in one embodiment by a rotor for a progressive cavity device. In an embodiment, the rotor has a central axis and comprises an outer tubular having a radially outer surface and a radially inner surface defining a rotor cavity. The outer surface includes at least one helical rotor lobe. In addition, the rotor comprises a filler structure disposed within the rotor cavity. The outer tubular is made of a first material having a first density and the filler structure is made of a second material having a second density that is less than the first density.

These and other needs in the art are addressed in another embodiment by a positive-displacement device. In an embodiment, the positive-displacement device comprises a stator. In addition, the positive-displacement device comprises a rotor rotatably disposed in the stator. The rotor has a central axis and includes an outer tubular having a radially outer surface and a radially inner surface defining a rotor cavity. The outer surface includes at least one helical rotor lobe. The rotor also includes a filler structure disposed within the rotor cavity. The outer tubular is made of a first material having a first density and the filler structure is made of a second material having a second density that is less than the first density.

These and other needs in the art are addressed in another embodiment by a rotor for a progressive cavity device. In an embodiment, the rotor has a central axis comprises an outer tubular having a radially outer surface including at least one helical rotor lobe. In addition, the rotor comprises an inner tubular disposed within the outer tubular. Further, the rotor comprises a filler structure radially disposed between the inner tubular and the outer tubular. The outer tubular is made of a first material having a first density, the inner tubular is made of a second material having a second density, and the filler material is made of a third material having a third density, wherein the third density is less than the first density and the second density.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
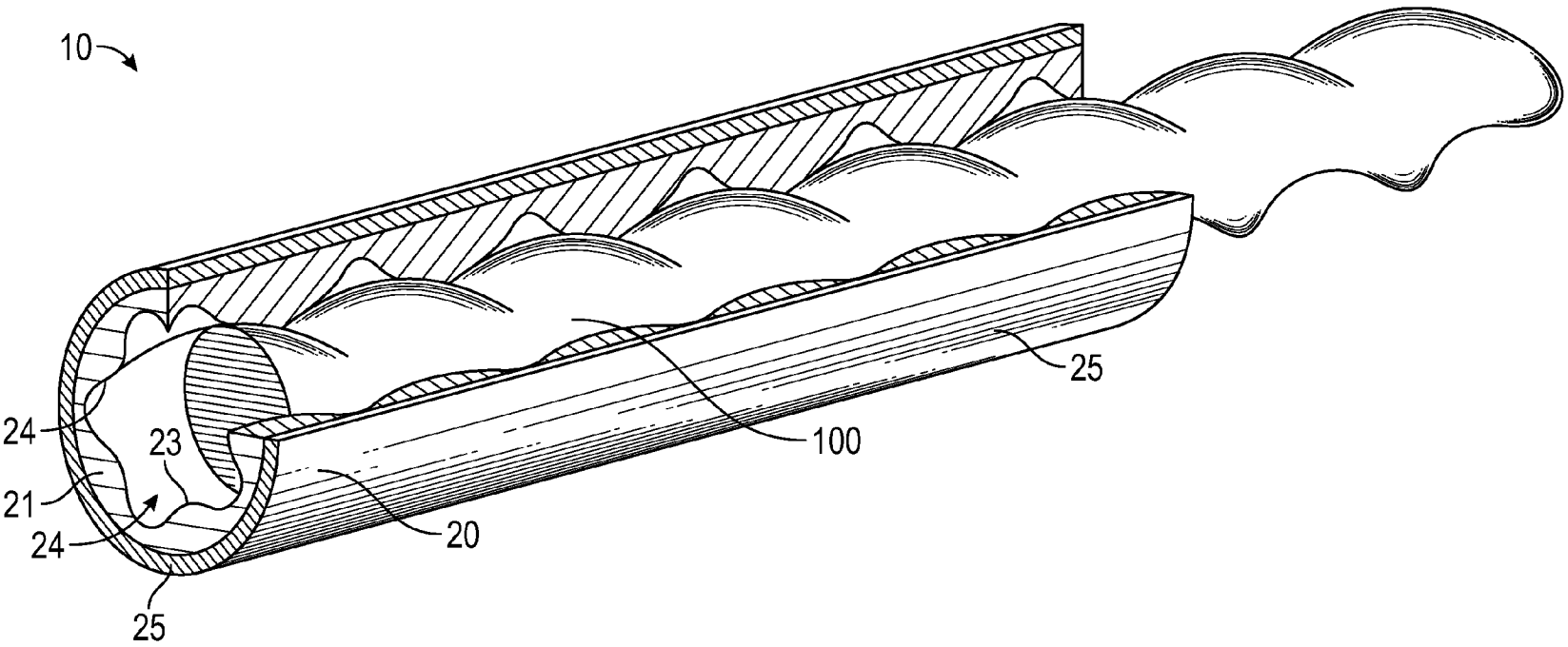
FIG. 1 is a perspective, partial cut-away schematic view of an embodiment of a progressive cavity device in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

In the following detailed description, numerous specific details may be set forth in order to provide a thorough understanding of embodiments of the invention. However, it will be clear to one skilled in the art when embodiments of the invention may be practiced without some or all of these specific details. In other instances, well-known features or processes may not be described in detail so as not to unnecessarily obscure the invention. In addition, like or identical reference numerals may be used to identify common or similar elements.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 2:
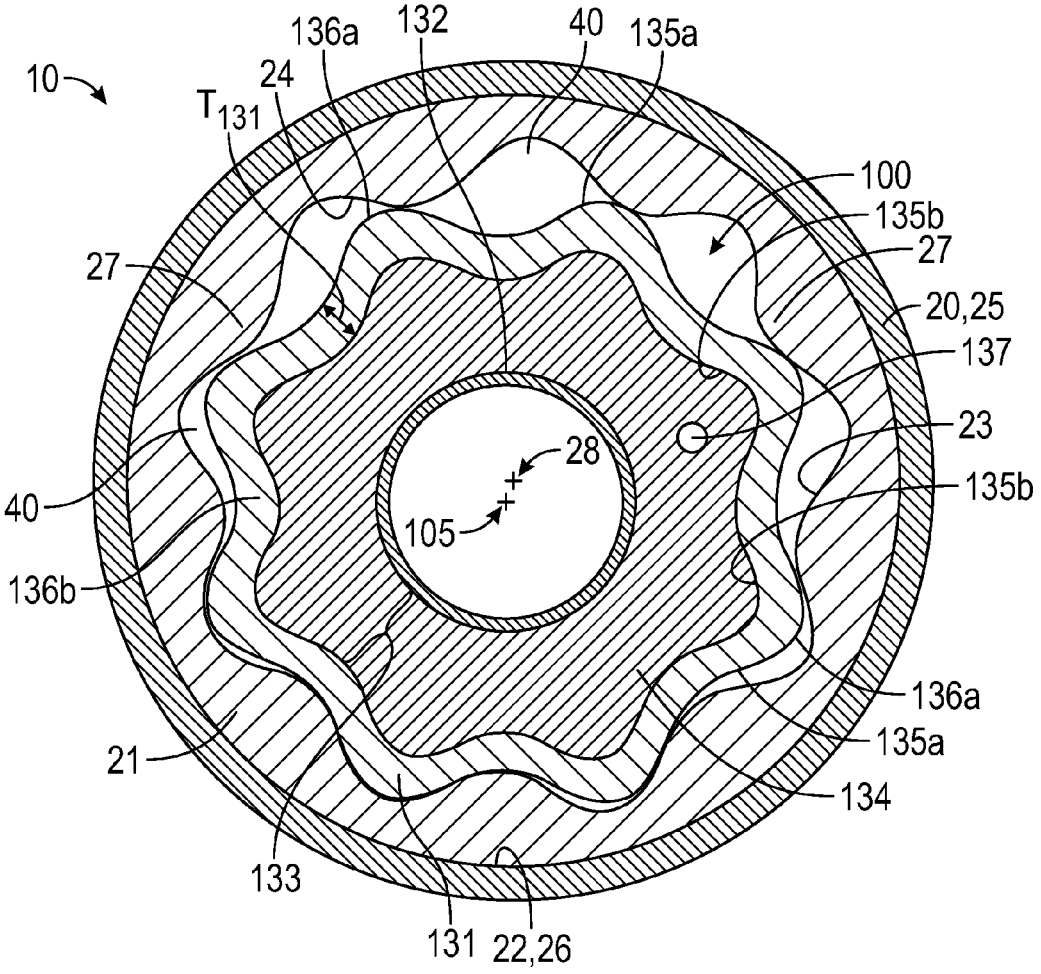
FIG. 2 is a cross-sectional view of the progressive cavity device of FIG. 1.

Referring now to FIGS. 1 and 2, an embodiment of a progressive cavity (PC) or positive displacement (PD) device 10 is shown. In general, PC device 10 can be employed as a progressive cavity pump or a progressive cavity motor. PC device 10 comprises a stator 20 and a rotor 100 rotatably disposed within stator 20.

Stator 20 has a central or longitudinal axis 28 and comprises an outer housing 25 and an elastomeric stator insert 21 coaxially disposed within housing 25. In this embodiment, housing 25 is a tubular (e.g., heat-treated steel tube) having a radially inner cylindrical surface 26, and insert 21 has a radially outer cylindrical surface 22 engaging surface 26. Surfaces 22, 26 are fixed and secured to each other such that insert 21 does not move rotationally or translationally relative to housing 25. For example, surfaces 22, 26 may be bonded together and/or surfaces 22, 26 may include interlocking mechanical features (e.g., surface 22 may include a plurality of radial extensions that positively engage mating recesses in surface 26). Insert 21 includes a helical through bore 24 defining a radially inner helical surface 23 that faces rotor 100. Helical surface 23 defines a plurality of circumferentially spaced helical stator lobes 27.

Although housing 25 and insert 21 have mating inner and outer cylindrical surfaces 26, 22, respectively, in this embodiment, in other embodiments, the stator housing (e.g., housing 25) has a helical-shaped radially inner surface defined by a helical bore extending axially through the housing, and the elastomeric insert is a thin, uniform radial thickness elastomeric layer or coating disposed on the helical inner surface of the housing.

In general, elastomeric stator insert 21 can be made from any suitable elastomer or mixture of elastomers. In embodiments described herein, the elastomeric stator insert (e.g., stator insert 21 or uniform radial thickness stator insert disposed on the inner surface of the stator housing) is preferably made from nitrile rubber, hydrogenated nitrile (HNBR), ethylene propylene diene monomer rubber (EPDM rubber), Chloroprene (neoprene), fluoroelastomers (FKM), epichlorohydrin rubber (ECO), natural rubber (NR), or combinations thereof. In general, elastomeric stator insert 21 may be formed by any suitable means known in the art including, without limitation, injection molding, transfer molding, extrusion, compression molding, or any other molding method.

Figure 3:
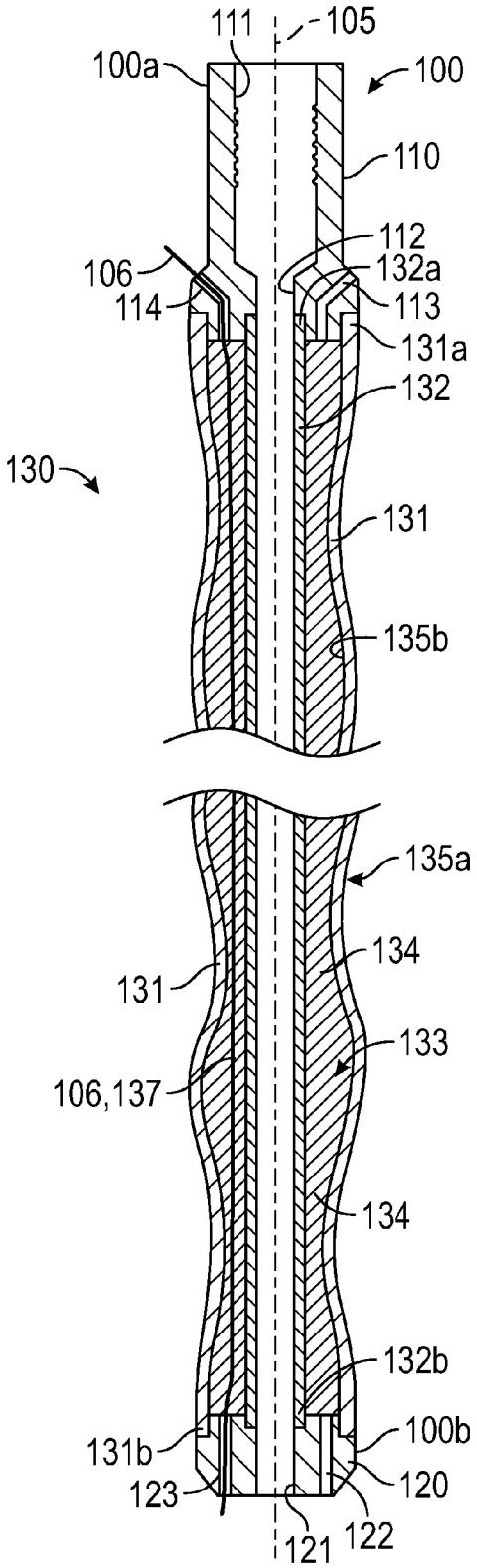
FIG. 3 is a cross-sectional view of the rotor of FIGS. 1 and 2.

Referring now to FIGS. 2 and 3, rotor 100 has a central or longitudinal axis 105, a first end 100*a*, and a second end 100*b* opposite end 100*a*. As will be described in more detail below, in this embodiment rotor 100 is a composite rotor made of a plurality of different materials configured to reduce the weight of rotor 100 and enhance the flexibility of rotor 100 as compared to a similarly sized conventional rotor. Consequently, rotor 100 is both lightweight and flexible as compared to a conventional rotor having a solid core (or core having a central throughbore) and made entirely of a ductile material such as steel.

In this embodiment, rotor 100 includes a rotor head 110 at end 100*a*, a rotor tail 120 at end 100*b*, and a rotor body 130 extending axially between head 110 and tail 120. Body 130 is fixably secured to head 110 and tail 120 at its ends such that head 110, body 130, and tail 120 move together (i.e., head 110, body 130, and tail 120 do not move rotationally or translationally relative to each other). When rotor 100 is used in a drilling operation, rotor tail 120 is disposed uphole of rotor head 110 (i.e., second end 100*b* is the uphole end and first end 100*a* is the downhole end).

Rotor body 130 includes a radially outer tube or tubular 131 and a radially inner tube or tubular 132 coaxially disposed within outer tubular 131. Each tubular 131, 132 has a first end 131*a*, 132*a*, respectively, coupled to rotor head 110 and a second end 131*b*, 132*b*, respectively, coupled to rotor tail 120. Thus, each tubular 131, 132 generally has the same axial length. In general, rotor head 110 and rotor tail 120 can be coupled to ends 131*a*, 132*a* and ends 131*b*, 132*b* of tubulars 131, 131, respectively, by any suitable means known in the art including, without limitation, threaded connections or welded connections.

In this embodiment, inner tubular 132 is radially spaced apart from outer tubular 131, and thus, an annular space or annulus 133 is radially disposed therebetween. In this embodiment, annulus 133 is completely filled with a filler material or structure 134. Annulus 133 and filler structure 134 disposed therein extend axially between head 110 and tail 120.

As best shown in FIG. 3, rotor head 110 includes an internally threaded counterbore 111 extending axially from end 100*a* and a throughbore 112 extending axially from counterbore 111 to the opposite end of head 110. The internally threaded counterbore 111 is used to threadably couple rotor 100 to another motor part, such as a flexible driveshaft or articulated driveshaft with universal joints, and for torque transmission. Rotor tail 120 includes a throughbore 121 extending axially therethrough. Counterbore 111 and throughbores 112, 121 are coaxially aligned with axis 105 and tubulars 131, 132, and further, throughbores 112, 121 are in fluid communication with inner tubular 132 (i.e., in fluid communication with the passage extending through the inside of tubular 132). When end 100*a* of rotor 100 is coupled to another component (e.g., another motor part) via counterbore 111, throughbores 112, 121 and tubular 132 define a flow passage extending axially through rotor 100 between ends 100*a*, 100*b*. In this embodiment, both rotor head 110 and rotor tail 120 are made of a ductile material such as steel.

Referring again to FIGS. 2 and 3, outer tubular 131 has a radially outer surface 135*a*, a radially inner surface 135*b*, and a thickness $T_{131}$ measured radially between surfaces 135*a*, 135*b*. In this embodiment, each surface 135*a*, 135*b* is profiled—each surface 135*a*, 135*b* is helical or helically shaped. Accordingly, as best shown in FIG. 2, outer surface 135*a* includes a plurality of circumferentially-spaced helical rotor lobes 136*a* and inner surface 135*b* includes a plurality of circumferentially-spaced helical rotor lobes 136*b*. Rotor lobes 136*a* intermesh stator lobes 27 defined by helical bore 24 in insert 21. The number of rotor lobes 136*a* formed on outer surface 135*a* of rotor 100 is one fewer than the number of lobes 27 on stator 20. When rotor 100 and the stator 20 are assembled, a series of cavities 40 are formed between the helical-shaped outer surface 135*a* of rotor 100 and the helical-shaped inner surface 23 of stator 20. Each cavity 40 is sealed from adjacent cavities 40 by seals formed along the contact lines between rotor 100 and stator 20. The central axis 105 of rotor 100 is parallel to and radially offset from the central axis 28 of stator 20 by a fixed value known as the "eccentricity" of PC device 10. When PC device 10 is operated as a pump, the rotation of rotor 100 relative to stator 20 drives the axial movement of cavities 40 through device 10 in the direction towards the end with the higher fluid pressure, and when PC device 10 is operated as a motor, the flow of fluid through cavities 40 from the end with a high fluid pressure to the end with the lower fluid pressure drives the rotation of rotor 100 relative to stator 20. Thus, embodiments of PC devices described herein (e.g., PC device 10) can be operated as motors or pumps.

Referring again to FIGS. 2 and 3, lobes 136*a*, 136*b* are parallel and circumferentially-aligned as they extend axially between ends 131*a*, 131*b*. Accordingly, in this embodiment, thickness $T_{131}$ is uniform along the entire circumference and axial length of outer tubular 131. However, in general, the thickness of the inner tubular (e.g., thickness $T_{131}$ of outer tubular 131) can be uniform or non-uniform. In general, thickness $T_{131}$ will depend on a variety of factors including, without limitation, the material properties of outer tubular 131. The material selected for outer tubular 131 is preferably suitable for the downhole environment, and further, the thickness $T_{131}$ and the material are preferably selected such that outer tubular 131 is capable of withstanding the anticipated operating loads while being somewhat flexible. Examples of a suitable materials for outer tubular 131 are steel and other ductile materials. Outer tubular 131 can be manufactured by any suitable means known in the art such as forming or other suitable method and could subsequently be machined or ground. Outer surface 135*a* can have a surface finish suitable for its application and/or can be heat-treated or coated with a suitable coating (e.g., Hard Chrome Plate and HVOF ("High Velocity Oxygen Fuel") type coatings) to enhance abrasion and corrosion resistance, as well as to minimize the coefficient of friction between the rotor 100 and stator 20.

As previously described, inner tubular 132 coaxially disposed within outer tubular 131. Inner tubular 132 decreases the amount of material in rotor body 130 allows rotor body 130 to flex between ends 130*a*, 130*b*, while adding strength and rigidity to rotor body 130. Inner tubular 132 can be used as a drilling fluid bypass. In particular, the passage extending through inner tubular 132 can be used to enable drilling fluid to flow between ends 100*a*, 100*b* of rotor 100 without passing through cavities 40.

Inner tubular 132 is preferably made of a ductile material such as steel. The material of inner tubular 132 can be the same as or different from the material of outer tubular 131. In this embodiment, inner tubular 132 has a cylindrical inner and outer surfaces, and thus, has a circular cross-section, however, in other embodiments the inner tubular (e.g., inner tubular 132) can have other cross-sectional shapes such as rectangular or polygonal.

Referring still to FIGS. 2 and 3, filler structure 134 is disposed in annulus 133. In this embodiment, filler structure 134 is bonded to both tubulars 131, 132 such that tubulars 131, 132 and filler structure 134 move together (i.e., tubulars 131, 132 and filler structure 134 do not move translationally or rotationally relative to each other). In general, filler structure 134 can be a pre-formed solid structure positioned between tubulars 131, 132, or be formed from a material injected or otherwise disposed in annulus 133 in a liquid or flowable state and then cured or hardened within annulus 133.

Filler structure 134 can be formed in annulus 133 before or after head 110, tail 120, and tubulars 131, 132 are assembled. In this embodiment, ports 113, 122 are provided in rotor head 110 and rotor tail 120, respectively, to aid in forming filler structure 134 within annulus 133 following the assembly of head 110, tail 120, and tubulars 131, 132. In particular, one port 113, 122 can be used to inject a liquid material into annulus 133 while the other port 122 allows venting of air from the annulus as the liquid material is injected into annulus 133. After filling annulus 133, the liquid material is allowed to cure or otherwise harden to form filler structure 134. Ports 113, 122 can be sealed after the injection of the liquid material to prevent the ingress of fluids in the environment into annulus 133.

In embodiments described herein, filler structure 134 is made of a material having a density less than the density of the material forming outer tubular 131 (e.g., steel). In this embodiment, the material of filler structure 134 is also less than the density of the material forming inner tubular 132 (e.g., steel). As a result, filler structure 134 reduces the weight of rotor 100 as compared to a conventional rotor of the same size made entirely of steel. In general, the material selected for filler structure 134 will depend on a variety of factors including, without limitation, the operating environment, anticipated loads, and the particular application. In general, the material for filler structure 134 can be selected to provide mechanical support to rotor body 130, to enhance the flexibility of rotor body 130 (i.e., to lessen the load required to bend rotor body), or combinations thereof. Examples of suitable materials for filler structure 134 included, without limitation, plastics, rubbers or elastomers, and other polymer materials. In this embodiment, filler structure 134 is provided with a plurality of uniformly distributed reinforcing fibers. In addition, filler structure 134 can include internal voids to further reduce the overall weight of rotor body 130.

Referring still to FIGS. 2 and 3, aligned holes 114, 123, 137 are provided in rotor head 110, rotor tail 120, and filler structure 134, respectively, for advancing a cable or wire 106 axially through rotor body 130 between tubulars 131, 132. The insertion of cable 106 is preferably such that its ends from holes 114, 123 and are available for connection to other components. With cable 106 extending through holes 114, 123, they are preferably sealed to prevent the ingress of fluid from the environment into annulus 133. In general, cable glands or other sealing means can be used to seal holes 114, 123. In the embodiment shown in FIGS. 2 and 3, hole 137 in formed in filler structure 134, and then cable or wire 106 is passed therethrough. Alternatively, the cable or wire 106 can be advanced through annulus 133 before filler structure 134, and then filler structure 134 is formed within annulus 133 resulting in cable 106 being embedded in the filler structure.

Figure 4:
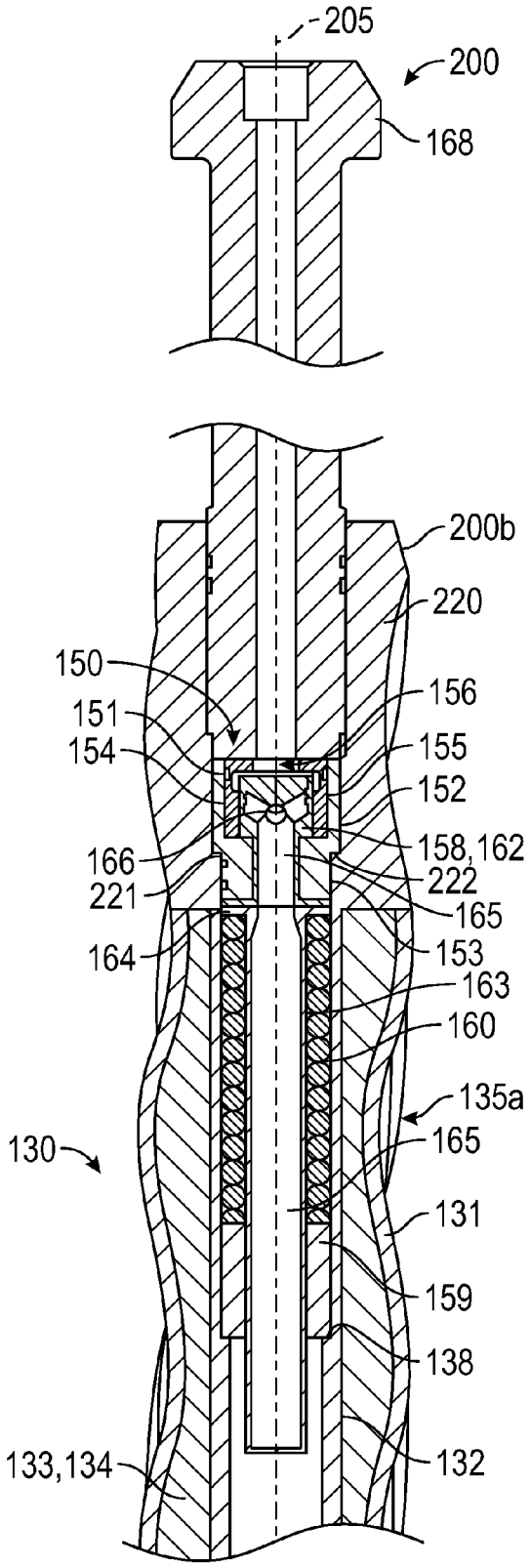
FIG. 4 is a cross-sectional view of an embodiment of a rotor in accordance with the principles described herein and including a flow control device.

Referring now to FIG. 4, an embodiment of a rotor 200 in accordance with the principles described herein is shown. In general, rotor 200 can be used with stator 20 in the place of rotor 100 to form a PC device. Rotor 200 is substantially the same as rotor 100 previously described. Namely, rotor 200 a central or longitudinal axis 205, a first end (not shown), and a second end 200*b* opposite the first end. In addition, rotor 200 includes a rotor head 102 (not shown) at the first end, a rotor tail 220 at end 200*b*, and a rotor body 130 extending axially between head 110 and tail 220. Rotor head 102 and body 130 are each as previously described. However, in this embodiment, rotor 200 includes a valve assembly 150 seated in rotor tail 220 and extending into inner tubular 132 to control the flow of fluids through inner tubular 132, which bypass cavities 40.

Rotor tail 220 includes a throughbore 221 extending axially therethrough. An annular shoulder 222 is provided in throughbore 221 and an annular shoulder 138 is provided in inner tubular 132. Valve assembly 150 includes an outer valve body 152, an inner valve body 154, and a plunger assembly 158. Outer valve body 152 is disposed in bore 221 of the rotor tail 220 and seated against annular shoulder 222. Inner valve body 154 is disposed within outer valve body 152. One or more annular seals 151 are provided between bodies 152, 154, and at least one annular seal 153 is provided between outer body 152 and rotor tail 220. Inner valve body 154 has an inner cavity 155 and an opening 156, which allows fluid to enter or leave the cavity 155. Plunger assembly 158 includes a plunger head 162 moveably disposed in cavity 155 and a tubular actuation member 163 extending axially from head 162 into inner tubular 132. An annular sleeve 159 is radially disposed between inner tubular 132 and actuation member 163, and is seated against shoulder 138. A biasing member or spring 160 is disposed within inner tubular 132 and axially positioned between sleeve 159 and a flange 164 provided on actuation member 163. Biasing member 160 is in compression, and thus, biases plunger head 162 against inner valve body 154 to close the opening 156.

Referring still to FIG. 4, a throughbore 165 extends axially through actuation member 163 and into plunger head 158, but is closed off at the end of plunger head 162 axially adjacent opening 156. In addition, plunger head 162 has a plurality of side orifices 166 in communication with bore 165 and cavity 155. Plunger head 162 is axially displaceable within inner valve body 154 by compression of biasing member 160. Thus, when fluid pressure applied to plunger head 162 through opening 156 exceeds the biasing force of biasing member 160, plunger head 162 moves away from opening 156, allowing fluid communication between opening 156 and side orifices 166 via cavity 155. Thus, under normal operations fluid is prevented from flowing through inner tubular 132 and bypassing cavities 40. However, if the fluid pressure pumped down the drill string exceeds the biasing force of biasing member 160, fluid is allowed to flow through inner tubular 132 and bypass cavities 40. This limits the fluid pressure acting between rotor 200 and stator 20 and other components. In an alternate embodiment, a simple plug or nozzle with a through-hole sized to allow a certain amount of fluid flow therethrough can be used in place of valve assembly 150. In general, valve assembly 150 and simple plug or nozzle may be referred to as flow control devices.

In this embodiment, rotor 200 also includes a rotor catch 168 coupled to rotor tail 220. Catch 168 can be latched onto and used to retrieve rotor 200 and the associated stator in which rotor 200 is rotatably disposed (e.g., in the event of some failure in the motor connection). In general, rotor catch 168 can be used with any rotor embodiment disclosed herein (e.g., rotor 100 of FIG. 3). The remaining details of the rotor 200 are as described above for the rotor 100 in FIGS. 2 and 3.

Figure 5:
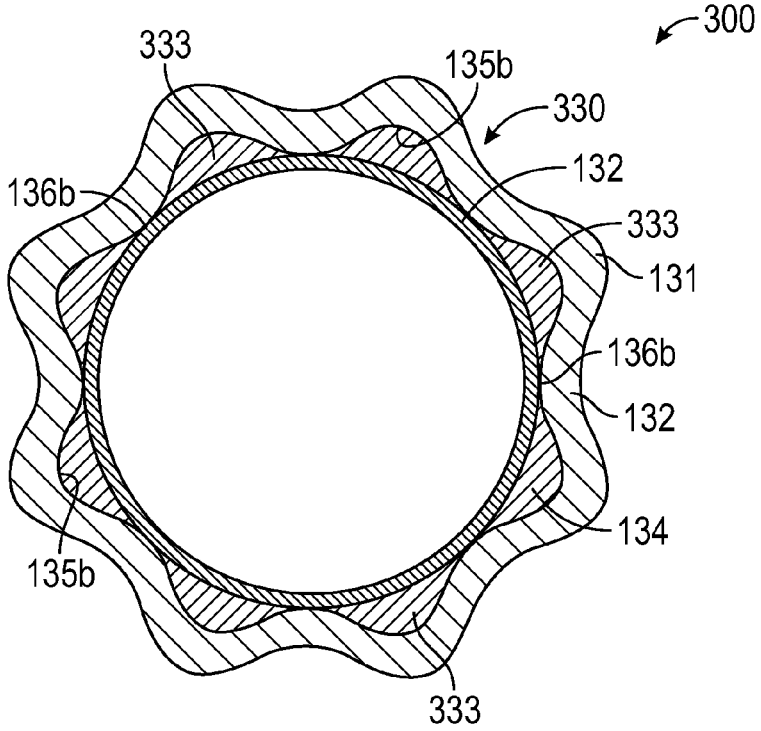
FIG. 5 is a cross-sectional view of an embodiment of a rotor body in accordance with the principles described herein.

In the embodiment of rotors 100, 200 previously described, inner tubular 132 is disposed within and radially spaced from outer tubular 131, resulting in annulus 133 extending radially therebetween, which is filled with filler structure 134. Thus, inner tubular 132 is radially spaced from inner surface 135*b* and helical rotor lobes 136*b* thereon. In other words, the radially innermost surfaces of lobes 136*b* are disposed at a radius that is larger than the outer radius of inner tubular 132. However, in other embodiments, the inner tubular (e.g., tubular 132) contacts the inner surface of the outer tubular (e.g., inner surface 135*b* of outer tubular 131) along the inner helical rotor lobes (e.g., lobes 136*b*). For example, referring now to FIG. 5, an embodiment of a rotor 300 including a rotor body 330 in accordance with the principles described herein is shown. In general, rotor 300 can be used with stator 20 in the place of rotor 100 to form a PC device. Rotor 300 and rotor body 330 are the same as rotor 100 and rotor body 130, respectively, as previously described, except that inner tubular 132 contacts and engages inner surface 135*b* of outer tubular 131 along helical rotor lobes 136*b*. In particular, a line contact is formed between the radially innermost surface of each lobe 136*b* and the cylindrical outer surface of inner tubular 132. Thus, the radially innermost surfaces of lobes 136*b* are disposed at a radius that is the same as the outer radius of inner tubular 132. As a result, annulus 133 is eliminated, effectively being replaced by a plurality of circumferentially-spaced isolated pockets or spaces 333 radially disposed between tubulars 131, 132. Each pocket 133 is filled with filler structure 134 as previously described. Filler structure 134 shown in FIG. 5 can be formed in the same manner(s) as filler structure 134 as previously described Inner tubular 132 can optionally be mechanically fixed to outer tubular 131 at one or more points of contact to improve the strength and rigidity of the rotor body 330. Moreover, filler structure 134 can optionally be bonded to outer tubular 131 and/or inner tubular 132 to improve the strength and rigidity of the rotor body 330.

Figure 6:
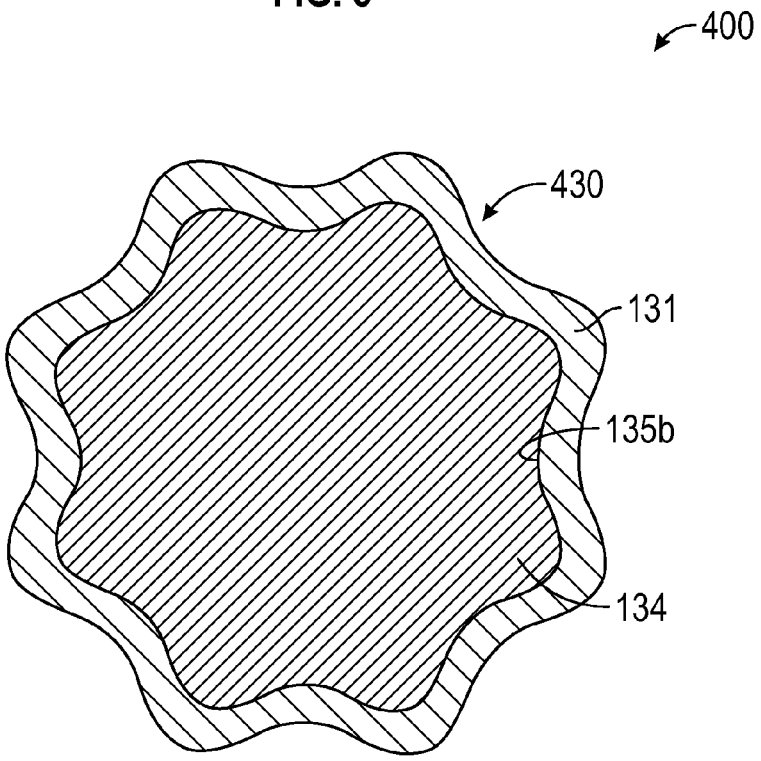
FIG. 6 is a cross-sectional view of an embodiment of a rotor body in accordance with the principles described herein.

In the embodiment of rotors 100, 200, 300 previously described, rotor body 130 includes inner tubular 132 disposed within outer tubular 131. However, in other embodiments, the inner tubular (e.g., tubular 132) is eliminated. For example, referring now to FIG. 6, an embodiment of a rotor 400 including a rotor body 430 in accordance with the principles described herein is shown. In general, rotor 400 can be used with stator 20 in the place of rotor 100 to form a PC device. Rotor 400 is the same as rotor 100 previously described except that no inner tubular (e.g., inner tubular 132) is provided. Rather, filler structure 134 as previously described completely fills the cavity within outer tubular 131. Filler structure 134 shown in FIG. 6 can be formed in the same manner(s) as filler structure 134 as previously described. Filler structure 134 can optionally be bonded to outer tubular 131 to improve the strength and rigidity of the rotor body 430.

Figure 7:
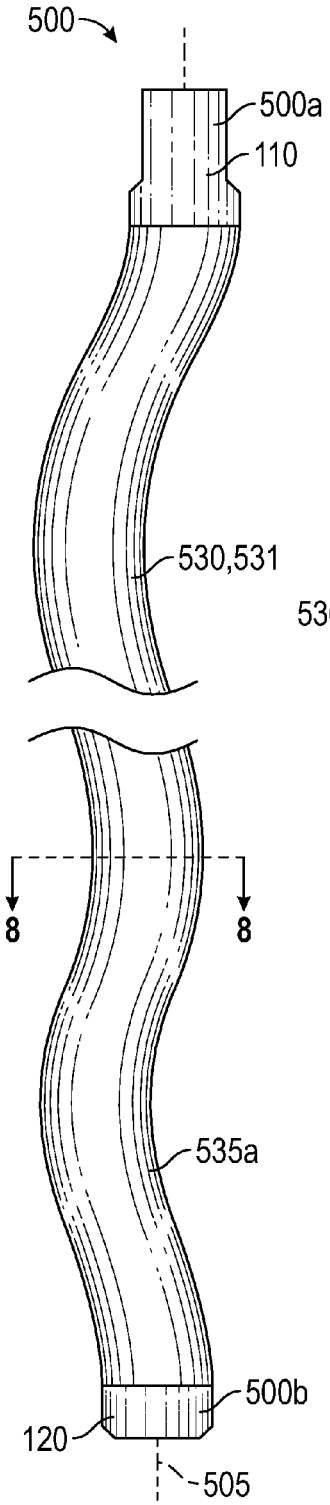
FIG. 7 is a side view of an embodiment of a rotor in accordance with the principles described herein and including a single-lobed rotor body.
Figure 8A:
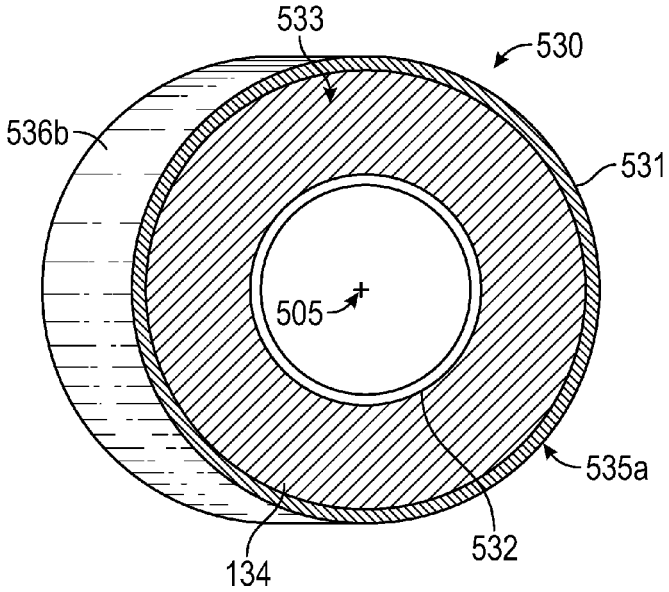
FIG. 8 is a cross-sectional view of the rotor body of FIG. 7 taken along section 8-8 of FIG. 7.
Figure 8B:
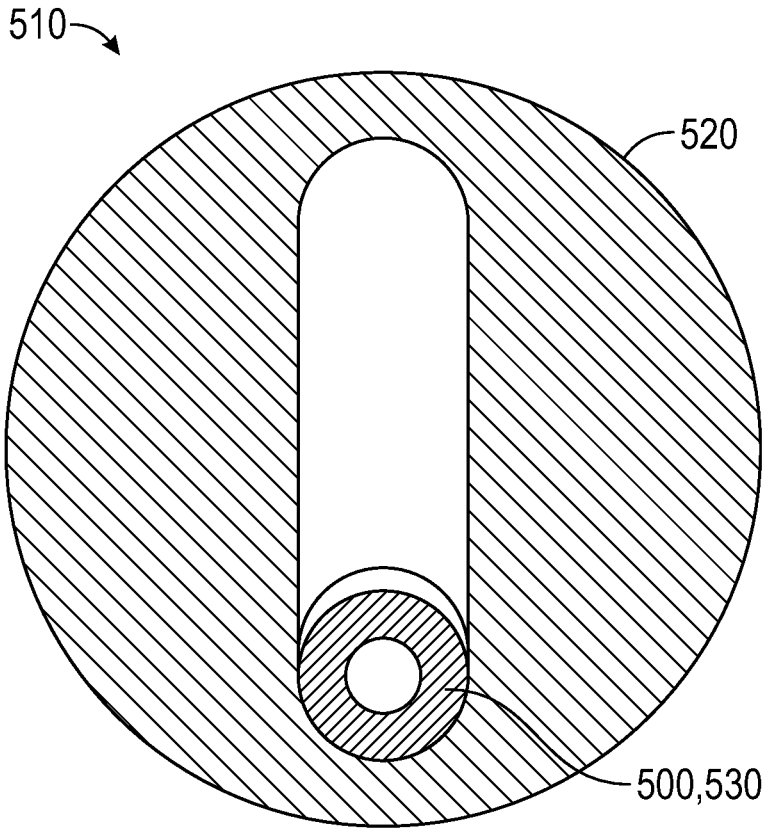
Figure 9:
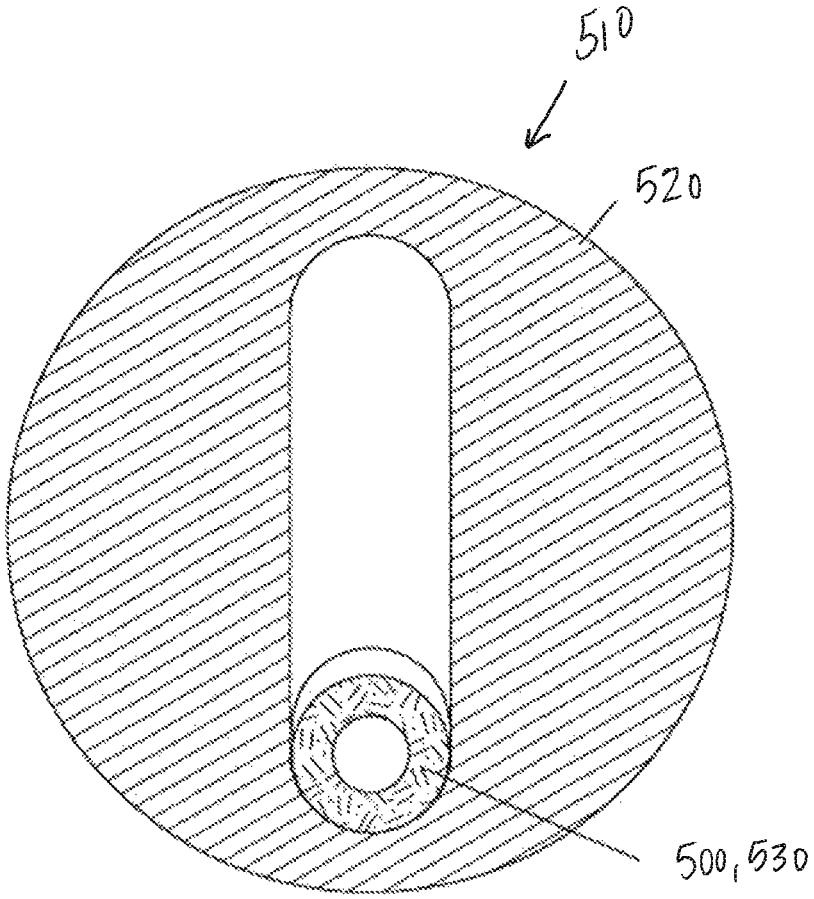
FIG. 9 is a cross-sectional view of an embodiment of a progressive cavity device including the single-lobed rotor body of FIG. 7.

In the embodiment of rotors 100, 200, 300 previously described, rotor body 130, and in particular, outer tubular 131 includes a plurality of radially outer helical rotor lobes 136*a*. However, in other embodiments, the rotor and outer tubular (e.g., outer tubular 131) include only one radially outer helical rotor lobe. For example, referring now to FIGS. 7 and 8, an embodiment of a rotor 500 in accordance with the principles described herein is shown. Rotor 500 is the same as rotor 100 previously described except that rotor 500 is a single lobed rotor. In particular, rotor 500 includes has a central or longitudinal axis 505, a first end 500*a*, and a second end 500*b* opposite end 500*a*. In addition, rotor 500 includes a rotor head 110 at end 500*a*, a rotor tail 120 at end 500*b*, and a rotor body 530 extending axially between head 110 and tail 120. Rotor head 110 and rotor tail 120 are each as previously described. Body 530 is fixably secured to head 110 and tail 120 at its ends such that head 110, body 530, and tail 120 move together (i.e., head 110, body 530, and tail 120 do not move rotationally or translationally relative to each other). Similar to rotor body 130 previously described, rotor body 530 includes a radially outer tube or tubular 531, a radially inner tube or tubular 532 coaxially disposed within outer tubular 531, and an annulus 533 radially disposed between tubulars 531. Annulus 533 is filled with filler structure 134 as previously described. Filler structure 134 shown in FIG. 8 can be formed in the same manner(s) as filler structure 134 as previously described. However, in this embodiment, outer tubular 531 has a radially outer surface 535*a* including only one helical rotor lobe 536*b*. FIG. 8 illustrates an embodiment of a PC device 510 including single-lobed rotor 500 rotatably disposed within a stator 520. The embodiment shown in FIG. 8 will work similarly to the embodiment shown in FIG. 2, except that the torque and speed characteristics will be different.

In embodiments described herein, the rotor includes a composite rotor body made of at least two different materials. In particular, the rotor body includes an outer tubular at least partially filled with a filler material that has a density less than the outer tubular. Consequently, embodiments described herein are generally lighter and more flexible than similarly sized conventional rotors made entirely of steel. This provides several potential advantages over conventional rotors made entirely of steel. For instance, by making the rotor lightweight, less work is required to rotate the rotor within the stator, resulting in lower loading on the stator. This offers the potential to reduce the pressure differential required to rotate the rotor within the stator, leaving more of the available pressure differential to develop torque. As another example, by making the rotor lightweight, the out-of-balance forces and other radial forces the rotor applies to the stator will be lower. As yet another example, by making the rotor more flexible such that it can bend more easily, the loads the rotor imparts on the stator profile when the stator is bent, e.g., during drilling of a curve, will be lower. The overall reduction in rotor loads imparted on the stator profile offer the potential to enhance the operating lifetime of the stator and improve performance of the PC device.

It should be appreciated that describing embodiments of rotors herein as being more flexible than a conventional rotor does not necessarily mean such rotors will physically flex more or further than a conventional rotor. Rather, what is meant by the phrase "more flexible" is that compared to a similarly sized the conventional rotor, less load is required to flex the rotor by the same amount or distance, thereby imparting less reactive load on the associated stator. It should also be appreciated that embodiments of rotors described herein can be sized and retrofit to existing stators. The internal configuration of embodiments of rotors described herein is what lends to the reduced weight and increased flexibility that can ultimately reduce the loads applied to the stator, and the internal configuration of embodiments of rotors described herein are independent of the stator design.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A rotor for a progressive cavity device, the rotor having a central axis and comprising:

an outer tubular having a radially outer surface and a radially inner surface defining a rotor cavity, wherein the outer surface includes at least one helical rotor lobe;

a filler structure disposed within the rotor cavity;

a rotor head tousled to a first end of the outer tubular, wherein the rotor head includes a first port extending from an outer surface of the rotor tail to the rotor cavity; and a rotor tail coupled to a second end of the outer tubular, wherein the rotor tail includes a second port extending from an outer surface of the rotor tail to the rotor cavity;

wherein the outer tubular is made of a first material having a first density and the filler structure is made of a second material having a second density that is less than the first density.

2. The rotor of claim 1, wherein the first material is steel and the second material is an elastomer or polymer.

3. The rotor of claim 1, further comprising an inner tubular disposed within the outer tubular, wherein the filler structure is radially positioned between the outer tubular and the inner tubular.

4. The rotor of claim 3, wherein an annulus is radially positioned between the inner tubular and the outer tubular, wherein the filler structure is disposed in the annulus.

5. The rotor of claim 3, wherein the radially inner surface of the outer tubular includes at least one helical lobe and wherein the inner tubular contacts the at least one helical lobe on the radially inner surface of the outer tubular.

6. The rotor of claim 3, wherein the inner tubular is made of a third material having a third density, wherein the second density is less than the third density.

7. The rotor of claim 6, wherein the first material and the third material are steel, the second material is an elastomer or polymer.

8. The rotor of claim 3, further comprising a flow control device disposed in the inner tubular, wherein the flow control device is configured to control the flow of fluids through the inner tubular.

9. The rotor of claim 3, wherein the filler structure is bonded to the outer tubular.

10. The rotor of claim 1, wherein the outer tubular has a uniform radial thickness.

11. A positive-displacement device, comprising:

a stator; and a rotor rotatably disposed in the stator, wherein the rotor has a central axis and includes:

an outer tubular having a radially outer surface and a radially inner surface defining a rotor cavity, wherein the outer surface includes at least one helical rotor lobe;

a filler structure disposed within the rotor cavity;

a rotor head coupled to a first end of the outer tubular, wherein the rotor head includes a first port extending from an outer surface of the rotor head to the rotor cavity; and a rotor tail coupled to a second end of the outer tubular, wherein the rotor tail includes a second port extending from an outer surface of the rotor tail to the rotor cavity;

wherein the outer tubular is made of a first material having a first density and the filler structure is made of a second material having a second density that is less than the first density.

12. The rotor of claim 11, further comprising an inner tubular disposed within the outer tubular, wherein the filler structure is radially positioned between the outer tubular and the inner tubular.

13. The rotor of claim 12, wherein an annulus is radially positioned between the inner tubular and the outer tubular, wherein the filler structure is disposed in the annulus.

14. The rotor of claim 12, wherein the radially inner surface of the outer tubular includes at least one helical lobe and wherein the inner tubular contacts the at least one helical lobe on the radially inner surface of the outer tubular.

15. The rotor of claim 12, wherein the inner tubular is made of a third material having a third density, wherein the second density is less than the third density.

16. The rotor of claim 15, wherein the first material and the third material are the same material.

17. The rotor of claim 16, wherein the first material and the third material are steel.

18. The rotor of claim 12, further comprising a flow control device disposed in the inner tubular, wherein the flow control device is configured to control the flow of fluids through the inner tubular.

19. A rotor for a progressive cavity device, the rotor having a central axis and comprising:

an outer tubular having a radially outer surface including at least one helical rotor lobe;

an inner tubular disposed within the outer tubular;

a filler structure disposed in the cavity;

a rotor head coupled to a first end of the outer tubular and a first end of the inner tubular, wherein the rotor head includes a first port extending from an outer surface of the rotor head to the cavity; and a rotor tail coupled to a second end of the outer tubular and a second end of the inner tubular, wherein the rotor tail includes a second sort extending from an outer surface of the rotor tail to the cavity; and wherein the outer tubular is made of a first material having a first density, the inner tubular is made of a second material having a second density, and the filler material is made of a third material having a third density, wherein the third density is less than the first density and the second density.

20. The rotor of claim 19, wherein the first density and the second density are the same.

21. The rotor of claim 20, wherein the first material and the second material are steel and the third material is an elastomer or polymer.

22. The rotor of claim 19, wherein an annulus is radially positioned between the inner tubular and the outer tubular, wherein the filler structure is disposed in the annulus.

23. The rotor of claim 19, wherein the filler structure is bonded to the outer tubular and the inner tubular.

* * * * *